US006044989A

United States Patent [19]

Sosso

[11] Patent Number: 6,044,989

[45] Date of Patent: Apr. 4, 2000

[54] DISPLAY RACK WITH INTERLOCKING DIVIDER AND DIVIDER ARRAY SYSTEMS

[75] Inventor: Peter F. Sosso, Minneapolis, Minn.

[73] Assignee: Stein Industries, Inc., Brooklyn Park, Minn.

[21] Appl. No.: 09/070,144

[22] Filed: Apr. 30, 1998

[51] Int. Cl.[7] ..... A47F 1/00

[52] U.S. Cl. ..... 211/189; 211/184; 211/59.4

[58] Field of Search ..... 211/59.2, 175, 211/184, 189, 59.4; 220/500, 528, 529, 532

[56] References Cited

U.S. PATENT DOCUMENTS

| | | | |
|---|---|---|---|
| D. 247,206 | 2/1978 | Hermann et al. | D6/184 |
| D. 351,748 | 10/1994 | Stein et al. | D6/511 |
| D. 375,002 | 10/1996 | Sosso | D6/449 |
| 783,976 | 2/1905 | Pinten . | |
| 1,554,211 | 9/1925 | Halevy . | |
| 1,677,544 | 7/1928 | Brainard et al. . | |
| 1,850,647 | 3/1932 | Whitcomb . | |
| 2,002,128 | 5/1935 | Reidenbaugh | 211/1 |
| 2,483,769 | 10/1949 | Hickey | 312/140.3 |
| 2,747,959 | 5/1956 | Ingelson | 312/140.3 |
| 2,933,195 | 4/1960 | Radek | 211/153 |
| 3,484,226 | 12/1969 | Golightly | 211/184 X |
| 3,501,020 | 3/1970 | Krikorian | 211/184 |
| 3,750,894 | 8/1973 | Jensen et al. | 211/184 |
| 3,810,323 | 5/1974 | Lowe | 40/124 |
| 3,872,976 | 3/1975 | Moore et al. | 211/184 |
| 4,077,522 | 3/1978 | Trubiano | 211/175 |
| 4,084,703 | 4/1978 | Hossalla et al. | 211/153 |
| 4,313,544 | 2/1982 | Ashton | 211/181 |
| 4,346,806 | 8/1982 | Bustos | 211/49 S |
| 4,562,928 | 1/1986 | Erickson | 211/184 |
| 4,595,246 | 6/1986 | Bross | 211/184 X |
| 4,662,523 | 5/1987 | Stein et al. | 211/59.2 |
| 4,729,485 | 3/1988 | Kulbersh | 211/184 |

(List continued on next page.)

FOREIGN PATENT DOCUMENTS 404 462 12/1965 Switzerland .

OTHER PUBLICATIONS

Profiler Line, Hinged Slant Back Rack, For Conventional Produce Wall Cases, Display Specialties, Inc., 1997.

The Problem: Produce Merchandising The Cure: AirFlo Merchandising Systems, Brochure, 1994, 1997.

*Primary Examiner*—Daniel P. Stodola
*Assistant Examiner*—Jennifer E. Novosad
*Attorney, Agent, or Firm*—Fish & Richardson P.C., P.A.

[57] ABSTRACT

A display rack incorporates an interlocking divider system that facilitates convenient installation and flexible adjustment of dividers to separate and organize displayed items such as produce, meat products, and the like. Also, a display rack may incorporate a divider array system, alone or in combination with interlocking dividers, having two or more horizontal divider mounting sections for convenient installation and flexible adjustment of dividers to provide an increased number of display options. The interlocking divider system allows easy installation of vertical dividers at different lateral positions along the display rack. Each vertical divider is configured for interlocking engagement with one or more horizontal dividers. In particular, each horizontal divider and vertical divider defines one or more mounting slots that interlock with one another to provide selective mounting of the vertical divider. The horizontal dividers can be formed with a unique bracket configuration that allows ready selection of horizontal divider depth by switching between different sides of the bracket. The divider array system incorporates two or more horizontal divider mounting sections disposed adjacent one another in a single rack. This configuration allows two or more horizontal dividers to be mounted not only at different heights, but also at different lateral positions along the rack. In this manner, an array of horizontal dividers can be distributed across the surface of the support member at different heights and lateral positions, enabling flexible selection of a greater variety of display and organization arrangements.

18 Claims, 12 Drawing Sheets

U.S. PATENT DOCUMENTS

| | | | |
|---|---|---|---|
| 4,765,492 | 8/1988 | Howard et al. | 211/184 X |
| 4,942,968 | 7/1990 | Fast | 211/184 |
| 5,154,299 | 10/1992 | Hwang | 211/184 X |
| 5,170,897 | 12/1992 | Wentworth | 211/181 |
| 5,242,223 | 9/1993 | Koves | 211/184 |
| 5,284,256 | 2/1994 | Correll-Antoun | 211/42 |
| 5,287,974 | 2/1994 | Buday | 211/184 |
| 5,314,080 | 5/1994 | Wentworth | 211/181 |
| 5,341,945 | 8/1994 | Gibson | 211/184 |
| 5,477,970 | 12/1995 | Watt et al. | 211/175 |
| 5,503,279 | 4/1996 | Wentworth | 211/175 |

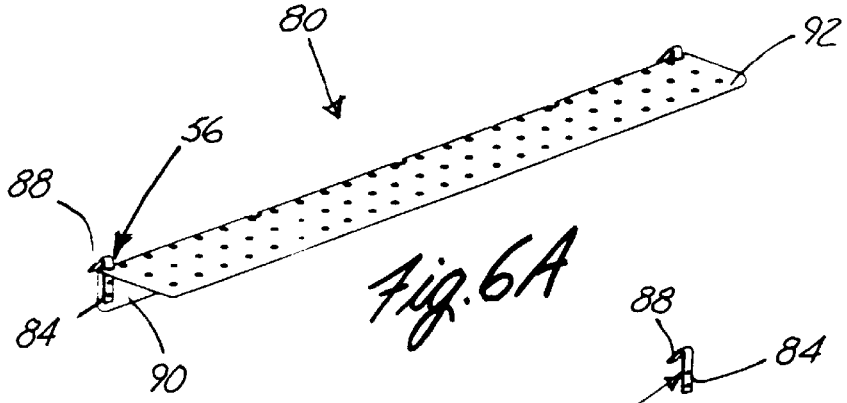
Fig. 6A
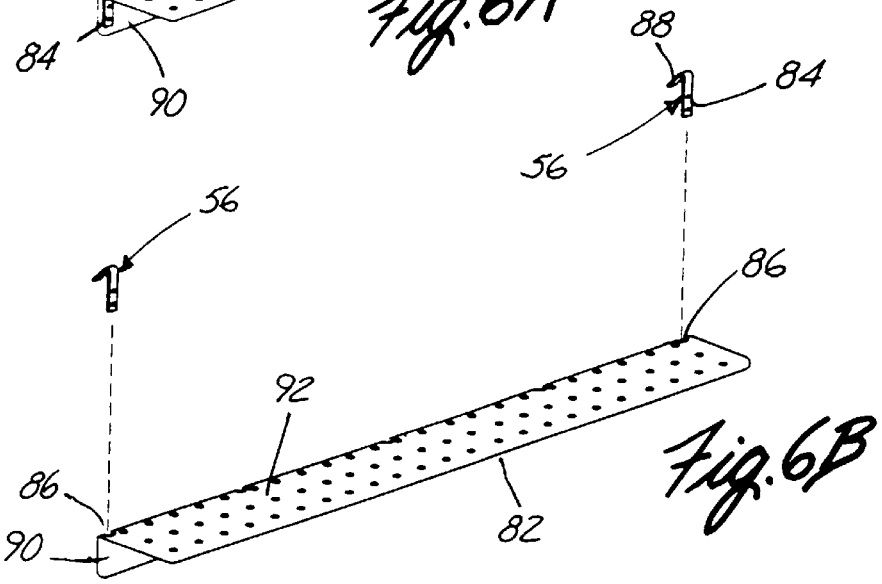
Fig. 6B
Fig. 7A
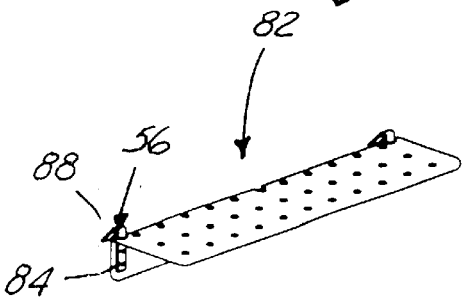
Fig. 7B
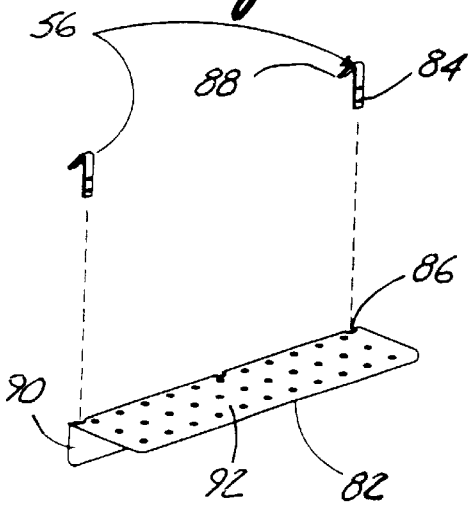

DISPLAY RACK WITH INTERLOCKING DIVIDER AND DIVIDER ARRAY SYSTEMS

FIELD

The present invention relates to display racks and, more particularly, to racks for displaying a variety of items such as produce, meat, and the like.

BACKGROUND

Display racks are widely used by a variety of merchandisers. Grocers, for example, use a variety of rack systems to organize and display grocery goods. As an illustration, produce, meat, and other perishable goods typically are displayed on racks mounted in refrigerated cases. Such racks often are configured to provide an appearance of greater stock quantities. In other words, the rack can provide the customer with a perception of increased size and bulk of goods in stock.

For example, a rack may include a series of steps that elevate and support the displayed goods. Alternatively, a rack may include one or more horizontal dividers that similarly operate to elevate and support the goods. Although such dividers may occupy an orientation other than horizontal, they are generally known in the art as horizontal dividers so long as they extend laterally across the support surface of the rack and act like shelves.

Some racks combine both a stepped profile and horizontal dividers. Also, racks can be mounted within the refrigerated case with sloping orientations. Moreover, some racks and divider systems are adjustable, allowing the stock person to select a desired arrangement and orientation. Steps and horizontal dividers also can be useful in supporting and organizing produce. For example, different varieties of produce, e.g., apples and oranges, can be displayed on different shelves or steps within a single display rack.

Horizontal dividers or steps serve to vertically separate the produce from one another at different elevations for ease of selection and product rotation. In addition, horizontal dividers or steps allow efficient use of a single rack for different types of produce when stock quantities are limited. Some racks incorporate dividers that laterally separate the produce. Such dividers are generally known in the art as vertical dividers, even though they may occupy different orientations depending on the orientation of the rack support surface. Vertical dividers can be used to provide added organization and further facilitate product rotation, and often are adjustable.

Existing display racks provide a wide variety of display options. However, display racks providing added display options and enhanced versatility continue to be desirable. At the same time, ease of installation and readjustment between display options remain a concern.

SUMMARY

The present invention, in one aspect, is directed to a display rack having an interlocking divider system that facilitates convenient installation and flexible adjustment of vertical dividers to separate and organize displayed items while providing structural integrity for a selected configuration. In another aspect, the present invention is directed to a display rack that incorporates a divider array system having two or more horizontal dividers arranged in laterally adjacent mounting sections, providing an added number of display options for greater versatility.

As used herein, "horizontal divider" generally refers to any divider mounted to extend laterally across a support surface of a display rack such that displayed items can be displayed at different elevations, regardless of any deviation of the divider support plane from an exactly horizontal orientation. A horizontal divider, in many cases, may function in part as a shelf to support displayed items. A "vertical divider" generally refers to any divider mounted to extend across a vertical, tilted, or reclined support surface of a display rack at an angle relative to any horizontal divider or relative to the lateral extent of the support surface, such that displayed items can be displayed at different lateral positions.

An interlocking divider system in accordance with the present invention allows easy installation of vertical dividers at different lateral positions along the display rack. Each vertical divider is configured for interlocking engagement with one or more horizontal dividers. In particular, each vertical divider and horizontal divider can define one or more mounting slots. The slots can be spaced apart at regular intervals along the edges of the vertical and horizontal dividers, providing a comb-like pattern. The slots defined by the vertical and horizontal dividers interlock with one another to provide selective mounting of the vertical divider at different positions along the length of one or more horizontal dividers and along the length of the vertical divider.

The vertical divider is readily removable from engagement with the horizontal divider, enabling convenient adjustment to achieve a variety of divider arrangements. However, the interlocking slots generally restrain the vertical divider against movement. Specifically, each slot defines a pair of opposing side surfaces. The side surfaces defined by the slots in the horizontal divider are oriented to bear against the vertical divider. In this manner, the horizontal divider limits the movement of the vertical divider in a direction along the length of the horizontal divider. Similarly, the side surfaces defined by the slots in the vertical divider are oriented to bear against the horizontal divider, thereby limiting the movement of the vertical divider in a direction transverse to the length of the horizontal divider. Consequently, the vertical divider remains generally fixed in a desired position, and resists inadvertent movement, for example, by shoppers removing items from the rack.

The interlocking arrangement is particularly effective when the vertical divider is mounted to engage two or more horizontal dividers disposed at different positions. In this arrangement, the slots defined by the horizontal dividers engage two or more slots in the vertical divider, securing the vertical divider at two or more points and providing added structural stability. The vertical divider is readily removable or adjustable, however, by simply lifting it out of engagement with the horizontal dividers. Also, the slots in the vertical divider can be spaced according to the spacing between various mounting positions for the horizontal dividers. Thus, the horizontal dividers can be selectively mounted at different heights on the surface of the support member, and still engage a corresponding slot on the vertical divider. As an alternative, the orientation of the dividers could be modified such that vertical dividers are mounted on the rack support surface, and the horizontal dividers are removably engaged with the vertical dividers.

The horizontal dividers can be formed with a unique configuration that allows ready selection of vertical divider depth. In particular, each horizontal divider can be formed as a bracket that includes two horizontal divider sections. Each horizontal divider section is selectively mountable against the surface of the support member, while the other horizontal divider section extends outward to support the displayed items and engage the slots in the vertical divider. Each horizontal divider section can be manufactured with a different depth, i.e., width extending outward from the surface of the support member. Different horizontal divider depths can be selected by simply selecting one of the horizontal divider sections to be mounted on the surface support member. In other words, the orientation of the horizontal divider bracket on the surface of the support member can be switched to select a desired horizontal divider depth. Different horizontal divider depths may be desirable for different types of items, such as differently sized fruits or vegetables.

A divider array system in accordance with the present invention incorporates two or more horizontal divider mounting sections disposed laterally adjacent one another in a single rack. This configuration allows two or more horizontal dividers to be mounted not only at different heights, but also at different lateral positions along the rack. For example, two horizontal dividers can be disposed side-by-side in adjacent mounting sections but at different heights. In this manner, an array of horizontal dividers can be distributed across the surface of the support member, enabling flexible selection of a greater variety of display and organization arrangements. Also, the mounting sections may include mounting sites arranged to receive longer horizontal dividers that extend across both mounting sections. As an example, a single rack could include one or more full length horizontal dividers in combination with one or more section length horizontal dividers. The horizontal dividers can be mounted on the rack, for example, by engagement with mounting structures such as holes, pins, tabs, hooks, flanges, and the like, provided within each mounting section. The mounting structures preferably are configured for removable engagement to facilitate flexible repositioning of the horizontal dividers between different vertical and lateral positions, as desired.

The divider array and interlocking divider features of the present invention can be adapted for a variety of rack configurations. Examples of the diverse racks to which the interlocking divider system could be applied included racks with tilted, sloping, flat, curved, stepped, multi-tier, telescoping, tiered, and adjustable arrangements. Further, such racks can be free-standing, case-mounted, or wall-mounted, and may include perforated plate materials, wire mesh materials, or wire frame materials. Thus, virtually any type of display rack can benefit from the flexibility, variety, and ease of installation afforded by laterally adjacent horizontal divider mounting sections and/or interlocking divider arrangements. The divider array and interlocking divider features can be practiced independently from one another with significant advantage. Combination of such features in a single rack, however, can greatly increase the number of display possibilities available to the rack user. Indeed, with multiple horizontal dividers arranged at different heights and lateral positions, interlocking dividers can be incorporated to not only divide the rack laterally and between horizontal dividers, but also to subdivide lateral portions of the rack at different heights. With greater subdivision, the resulting rack is even more versatile, supporting the display and separation of several different types of items on a single rack. Such a rack affords greater display efficiency while mitigating the appearance of smaller stock quantities.

The present invention, in one embodiment, provides a display rack comprising a support member having a surface to support items to be displayed, a horizontal divider mounted over the surface of the support member and extending in a first direction, a vertical divider mounted over the surface of the support member and extending in a second direction, a first mounting structure forming part of the horizontal divider, the first mounting structure being configured to removably engage a portion of the vertical divider and limit movement of the vertical divider in the first direction, and a second mounting structure forming part of the vertical divider, the second mounting structure being configured to removably engage a portion of the horizontal divider and limit movement of the vertical divider in the second direction.

In another embodiment, the present invention provides a display rack comprising a support member having a surface arranged to support items to be displayed, a first horizontal divider mounted on the surface of the support member, the first horizontal divider extending in a first direction across the surface of the support member, wherein the first horizontal divider includes a first horizontal divider surface defining a plurality of first slots, a second horizontal divider mounted on the surface of the support member, the second horizontal divider extending in the first direction across the surface of the support member, wherein the second horizontal divider includes a second horizontal divider surface defining a plurality of second slots, and a vertical divider extending in a second direction across the surface of the support member, wherein the vertical divider includes a vertical dividing surface defining a plurality of third slots, wherein each of the third slots is removably interlockable with one of the first slots and with one of the second slots to limit movement of the vertical divider against movement in the first and second directions, whereby the vertical divider is mountable at a plurality of positions along a length of the first horizontal divider and at a plurality of positions along a length of the second horizontal divider.

In a further embodiment, the present invention provides a display rack comprising a support member having a surface to support items to be displayed, a horizontal divider mounted over the surface of the support member, the horizontal divider having a length extending across the surface of the support member in a first direction and a width extending outward from the surface of the support member, a vertical divider mounted over the surface of the support member, the vertical divider having a length extending in a second direction substantially transverse to the first direction and a width extending outward from the surface of the support member, a plurality of first mounting structures forming part of the horizontal divider and distributed along the length of the horizontal divider, each of the first mounting structures being configured for selective removable engagement with a portion of the vertical divider to limit movement of the vertical divider in the first direction, and a plurality of second mounting structures forming part of the vertical divider and distributed along the length of the vertical divider, each of the second mounting structures being configured for selective removable engagement with a portion of the horizontal divider to limit movement of the vertical divider in the second direction.

In an additional embodiment, the present invention provides a display rack comprising a support member having a surface to support items to be displayed, a horizontal divider positionable over the surface of the support member, and a vertical divider positionable over the surface of the support member, wherein the horizontal divider and vertical divider define complementary slot patterns that are removably interlockable with one another to limit movement of the vertical divider in at least two dimensions.

The present invention further provides, in one embodiment, a display rack comprising a support member having a surface to support items to be displayed, a plurality of mounting sections arranged laterally adjacent one another across the surface of the support member, and a plurality of horizontal dividers, each of the horizontal dividers being mounted within one of the mounting sections.

In another embodiment, the present invention provides a display rack comprising a support member having a surface to support items to be displayed, a first mounting section arranged on the surface of the support member, a second mounting section arranged on the surface of the support member beside the first mounting section, at least a first pair of mounting sites disposed within the first mounting section to receive a horizontal divider, and at least a second pair of mounting sites disposed within the second mounting section to receive another horizontal divider.

In a further embodiment, the present invention provides a horizontal divider bracket for mounting on a display rack, the horizontal divider bracket comprising a first horizontal divider section, a second horizontal divider section oriented at an angle relative to the first vertical horizontal plate, the first and second horizontal divider sections having different depths, and wherein the second horizontal divider plate is mountable on the surface of a support member such that at least a portion of the second horizontal divider section lies substantially parallel to the surface of the support member and the first horizontal divider section extends outward from the surface of the support member to support items to be displayed.

The details of one or more embodiments of the invention are set forth in the accompanying drawings and the description below. Other features, objects, and advantages of the invention will be apparent from the description and drawings, and from the claims.

DESCRIPTION OF DRAWINGS

FIGS. 6A and 6B are diagrams illustrating full-length, variable depth horizontal dividers for use with a display rack as shown in FIGS. 2 or 4;

FIGS. 7A and 7B are diagrams illustrating section-length, variable depth horizontal dividers for use with a display rack as shown in FIGS. 2 or 4;

Like reference numbers and designations in the various drawings indicate like elements.

DETAILED DESCRIPTION

Figure 1:
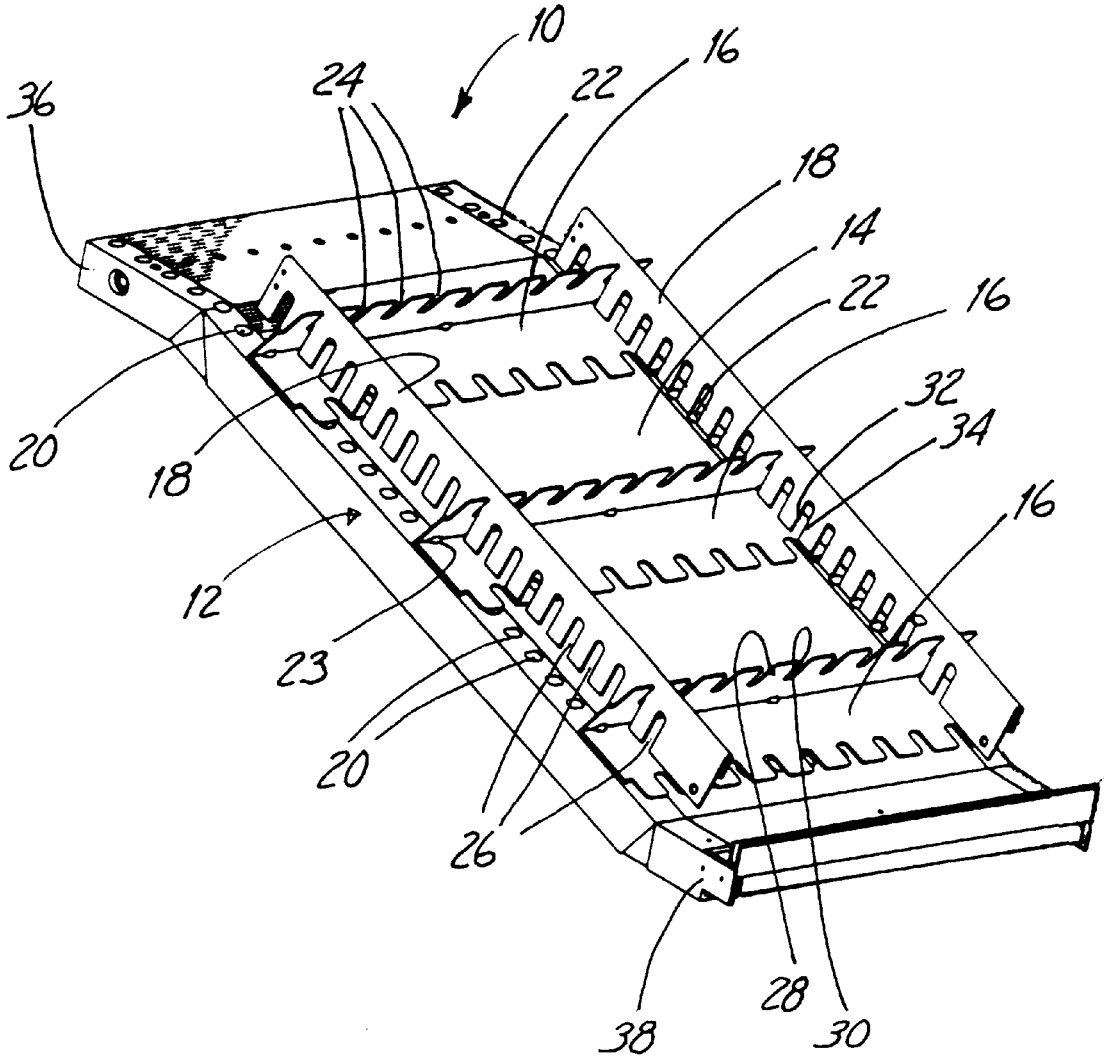
FIG. 1 is a diagram of a display rack incorporating an interlocking divider system.

FIG. 1 is a diagram of a display rack 10 incorporating an interlocking divider system in accordance with an embodiment of the present invention. As shown in FIG. 1, rack 10 includes a support member 12 having a surface 14 to support items to be displayed, one or more horizontal dividers 16 mounted over the surface of the support member, and one or more vertical dividers 18 mounted over the surface of the support member. Horizontal dividers 16 are mounted to extend across support surface 14 in a first, lateral direction. Also, horizontal dividers 16 can be selectively mounted at different positions on support surface 14 for differing elevation. In particular, several sets of mounting sites 20, 22 can be provided along the lateral edges of support surface 14 to receive horizontal dividers 16. Each horizontal divider 16 may include reciprocal mounting structure for engagement with mounting sites 20, 22.

Mounting sites 20, 22 may take the form of holes, pins, tabs, hooks, flanged structures, and the like. In the example of FIG. 1, mounting sites 20, 22 are mounting holes defined by support surface 14. Horizontal dividers 16 may include pins, tabs, hooks, or flanged structures for removable engagement with the mounting holes. In the example of FIG. 1, the mounting structures on horizontal dividers 16 are tabs 23. Vertical dividers 18 extend in a second direction generally transverse to the first direction, and can be mounted at several positions along horizontal dividers 16. As an alternative, vertical dividers 18 could be mounted on support surface 14, with horizontal dividers 16 mounted on the vertical dividers. In this case, vertical dividers 18 could be constructed with mounting hardware for attachment to support surface 14. Horizontal dividers 16 serve to support items to be displayed at different elevations relative to support surface 14. In this manner, horizontal dividers 16 act like shelves. Vertical dividers 18 serve to laterally separate items to be displayed across support surface 14.

Each horizontal divider 16 includes at least one mounting structure forming part of the horizontal divider and configured for engagement with one or more vertical dividers 18. The mounting structure is configured to removably engage a portion of the vertical divider 18 to limit movement of the vertical divider in the first direction. Similarly, a second mounting structure forming part of vertical divider 18 is configured to removably engage a portion of horizontal divider 16 and limit movement of the vertical divider in the second direction. In the example of FIG. 1, the first and second mounting structures may take the form of one or more slots defined by horizontal divider 16 and vertical divider 18, respectively. In particular, as shown in FIG. 1, horizontal divider 16 and vertical divider 18 preferably define patterns of slots 24, 26, respectively. Slots 24, 26 can be spaced at substantially regular intervals along the length of the vertical and horizontal dividers 16, 18. To facilitate engagement of vertical divider 18 with two or more horizontal dividers 16 mounted at different positions, for example, it is desirable that slots 22 be spaced at intervals commensurate with the mounting positions of the vertical dividers. Again, the arrangement of vertical dividers 18 and horizontal dividers 16 could be interchanged such that the vertical dividers are equipped with mounting hardware and mounted to support surface 14.

First and second slots 24, 26 are removably interlockable with one another to limit movement of vertical divider 18 member in first and second directions. Specifically, each of first slots 24 defines a pair of first side surfaces 28, 30 oriented to bear against vertical divider 18 in response to movement of the vertical divider. First side surfaces 28, 30 act as stops that thereby limit movement of vertical divider 18 in the first direction and in a direction opposite the first direction. Each of second slots 26 likewise defines a pair of second side surfaces 32, 34 oriented to bear against horizontal divider 16 when vertical divider 18 is moved. Second side surfaces 32, 34 limit such movement of vertical divider 18 in the second direction and in a direction opposite the second direction, i.e., lateral movement. Thus, the interlocking engagement of slots 24, 26 serves to restrain vertical divider 18 against movement in two dimensions, thereby maintaining the vertical divider in a particular position.

If desired, dividers 16, 18 and slots 24, 26 can be sized such that, upon engagement of one of the first slots with one of the second slots, the dividers extend outward from surface 14 of support member 12 with a substantially common depth. The widths of slots 24, 26 can be sized approximately equal to the thickness of dividers 16, 18, and could be sized small enough to provide a friction fit between the dividers and slots. To facilitate installation and alignment, however, particularly in view of the possibility of thermal expansion and resulting deviation from tolerances, slots 24, 26 preferably are sized somewhat larger than the thicknesses of dividers 16, 18. For example, slots 24, 26 can be sized to allow some degree of movement of dividers 16, 18, so long as significant movement is limited by side surfaces 28, 30, 32, 34, as applicable. In either case, the interlocking engagement of dividers 16, 18 is substantially resistant to inadvertent movement, thereby maintaining the desired display arrangement.

At the same time, however, the position of vertical divider 18 can be easily readjusted by simply lifting it out of engagement with horizontal divider 16 and reengaging one of slots 26 with a different one of slots 24. In this manner, vertical divider 18 is selectively mountable at different positions along the length of horizontal divider 16 and, consequently, at different lateral positions along support surface 14. Moreover, each of second slots 26 can be selectively engaged with one of first slots 24 such that vertical divider 18 is selectively mountable at different vertical positions. In other words, with a plurality of second slots 26, vertical divider 18 can be selectively mounted at different elevations on support surface 14. In each case, interlocking engagement of one of first slots 24 with one of second slots 26 generally fixes the lateral and elevational position of vertical divider 18 until readjustment is desired. The interlocking arrangement is particularly effective when the vertical divider 18 is mounted to engage two or more horizontal dividers 16 disposed at different positions. In this arrangement, first slots 24 defined by different horizontal dividers 16 engage two or more of second slots 26 along vertical divider 18, thereby securing the vertical divider at two or more points and providing added structural stability. The interlocking engagement is very useful when support surface 14 occupies a vertical orientation, but is even more effective as the support surface tilts away from vertical. In this latter case, vertical dividers 18 are generally restrained against lateral and vertical movement, but also are urged against support surface 14 by gravitational forces.

An interlocking divider system, in accordance with the present invention, can have a variety of dimensions, i.e., widths, heights, depths, etc. Also, such an interlocking divider system can be adapted for a variety of rack configurations other than that shown in FIG. 1. Accordingly, the particular type of rack to which the divider system is applied should not be seen as limited by FIG. 1. Rather, as exemplified below, the utility of an interlocking divider system as described herein with a number of diverse rack configurations should readily occur to those skilled in the art. Examples of the diverse racks to which the interlocking divider system could be applied include racks with tilted, sloping, flat, curved, stepped, multi-tier, telescoping, tiered, and adjustable arrangements. Further, such racks can be free-standing, case-mounted, or wall-mounted, and may include perforated plate materials, wire mesh materials, or wire frame materials.

As an example, FIG. 1 illustrates support member 12 as being formed from a plate-like material. In particular, support member 12 may be manufactured from a sheet of metal, such as aluminum or stainless steel, that is stamped and bent to take a desired form. Also, the metal sheet can be formed with a mesh configuration or perforated to define a pattern of air circulation holes. An example of a display rack incorporating a perforated aluminum plate is the Carlson AirFlo PR 5-30 vertical merchandiser rack, commercially available from Carlson Store Fixture Company of Minneapolis, Minn. As an alternative, support member 12 could be readily formed by a wire frame without significant modification of the interlocking divider system. An example of a display rack incorporating a wire frame is disclosed in U.S. Pat. No. 5,503,279 to Wentworth.

In the example of FIG. 1, support member 12 includes top and bottom mounting sections 36, 38 for mounting rack 10 within a display case, such as a refrigerator case. Mounting sections 36, 38 can be equipped with holes, pins, bolts, or other mounting structure to facilitate mounting with appropriate case hardware. Telescoping mounting sections can be provided to fit a wide range of case dimensions. An example of a rack incorporating telescoping mounting sections is the Carlson AirFlo Big Pac X3206 flat rack, commercially available from Carlson Store Fixture Company of Minneapolis, Minn. Alternatively, the rack could be fitted with extension brackets, on a selective basis, to allow the rack to fit particular case dimensions. As another alternative, support member 14 could be mounted in a free-standing rack frame or wall-mounted. The interlocking arrangement of dividers 16, 18 would be readily applicable to such configurations.

Further, as shown in FIG. 1, support member 12 defines a generally planar support surface 14. However, support member 12 could have a support surface 14 with a curved or stepped profile to provide a number of different elevations. The curved or stepped profile could be realized by a single support section with the desired profile, or by two or more adjacent sub-sections tilted at angles relative to one another. An example of a rack incorporating a stepped profile is the Carlson AirFlo PR5-25 double step rack, commercially available from Carlson Store Fixture Company of Minneapolis, Minn. In this case, vertical dividers 18 could be curved or stepped to conform to the profile of support surface 14. Alternatively, independent vertical dividers 18 could be provided for different sections of the curved or stepped support surface 14.

As also shown in FIG. 1, support member 12 could have a generally fixed orientation when installed in a case. As another alternative, support member 12 could be manufactured with an adjustable configuration, such as a hinge, whereby support surface 14 can be selectively repositioned to occupy a number of different orientations. A portion of support member 12 could be mounted on an adjustable swing arm or other repositionable support means, for movement about the hinge. The swing arm could be configured to engage the case or a base frame on rack 10. An example of a display rack having an adjustable orientation is the Carlson AirFlo PR 5-30 vertical merchandiser rack, commercially available from Carlson Store Fixture Company of Minneapolis, Minn. An example of an ornamental design for an adjustable rack is disclosed in U.S. Design Pat. No. D375,002 to Jerome F. Sosso. An interlocking divider system as described herein would be readily applicable to an adjustable rack system.

Figure 2:
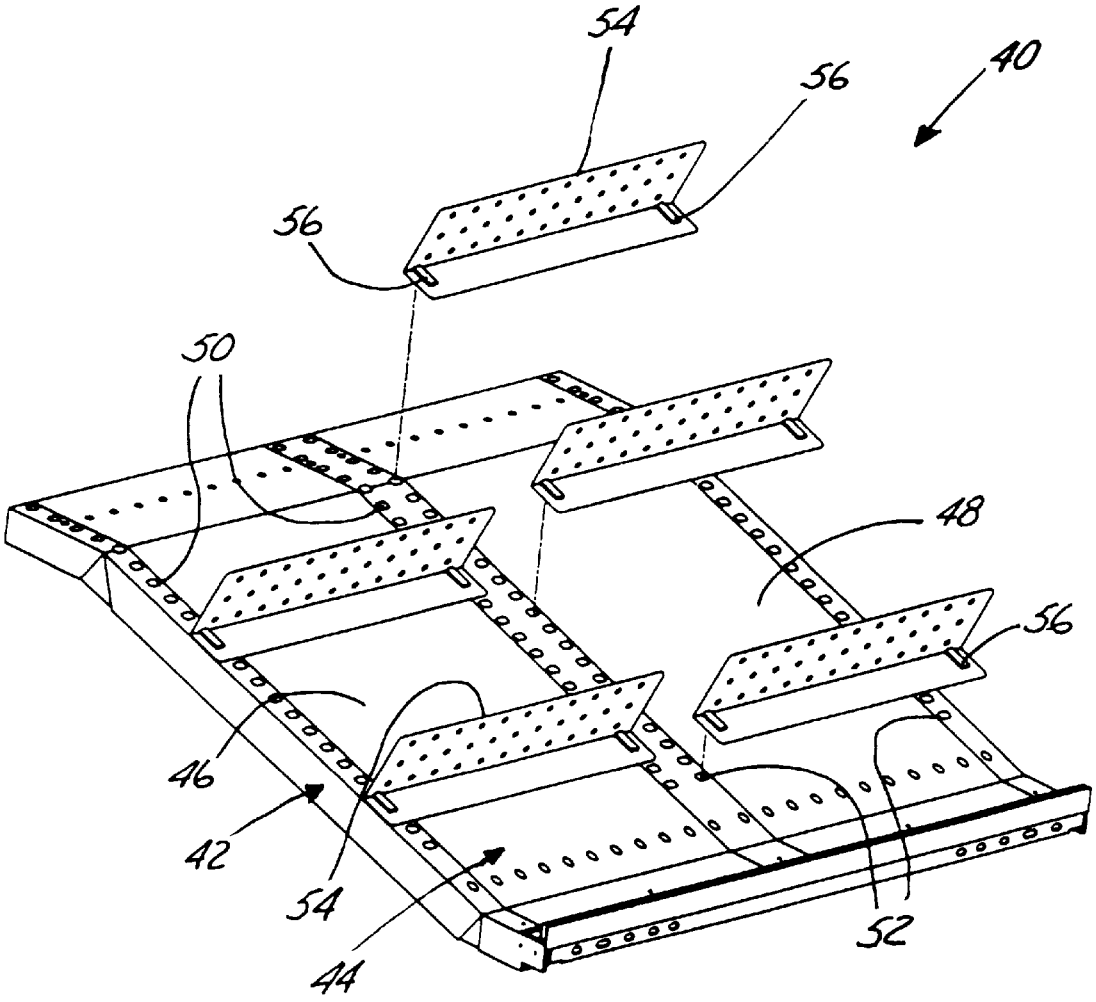
FIG. 2 is a diagram of a display rack incorporating a divider array system.

FIG. 2 is a diagram of a display rack 40 incorporating a divider array system in accordance with another embodiment of the present invention. As shown in FIG. 2, rack 40 substantially conforms to rack 10 of FIG. 1. Rack 40 further includes, however, a support member 42 providing a surface 44 having a first mounting section 46 and a second mounting section 48 disposed laterally adjacent one another. First mounting section 46 includes a first set of mounting sites 50, whereas second mounting section 48 includes a second set of mounting sites 52. Each mounting section 46, 48 is designed to receive one or more horizontal dividers 54 by engagement with mounting sites 50, 52, respectively. Mounting sites 50, 52 may take the form of holes, pins, tabs, hooks, flanges, and the like, arranged in pairs of columns within each mounting section 46, 48 respectively, for engagement with reciprocal structure on horizontal dividers 54. In the example of FIG. 2, mounting sites 50, 52 are holes defined by support surface 44. In this case, horizontal dividers 54 may include pins, tabs, hooks, or flanged structures for removable engagement with the mounting holes. In the example of FIG. 2, the mounting structures on horizontal dividers 54 are tabs 56.

With an arrangement as shown in FIG. 2, two or more horizontal dividers 54 can be mounted not only at different heights, but also at different lateral positions along support surface 44, providing substantial versatility for a single rack. For example, two horizontal dividers 54 can be disposed side-by-side on support surface 44 or at different heights in adjacent mounting sections 46, 48, providing a wide array of display options. Horizontal dividers 54 preferably are configured for removable engagement with mounting sites 50, 52 to facilitate flexible installation and repositioning of the horizontal dividers as desired. Mounting sections 46, 48 can be integrally formed in the same support surface 44, i.e., on a common sheet of metal or common wire frame. If rack 40 includes multiple step sections, however, mounting sections 46, 48 likewise can be formed in sections. Also, mounting sections 46, 48 conceivably could be formed in discrete support surface sections that are disposed adjacent one another and mechanically coupled together to provide an overall support surface 44. Like an interlocking divider system as illustrated by FIG. 1, the divider array system can be adapted for a variety of rack configurations other than that shown in FIG. 2.

Figure 3A:
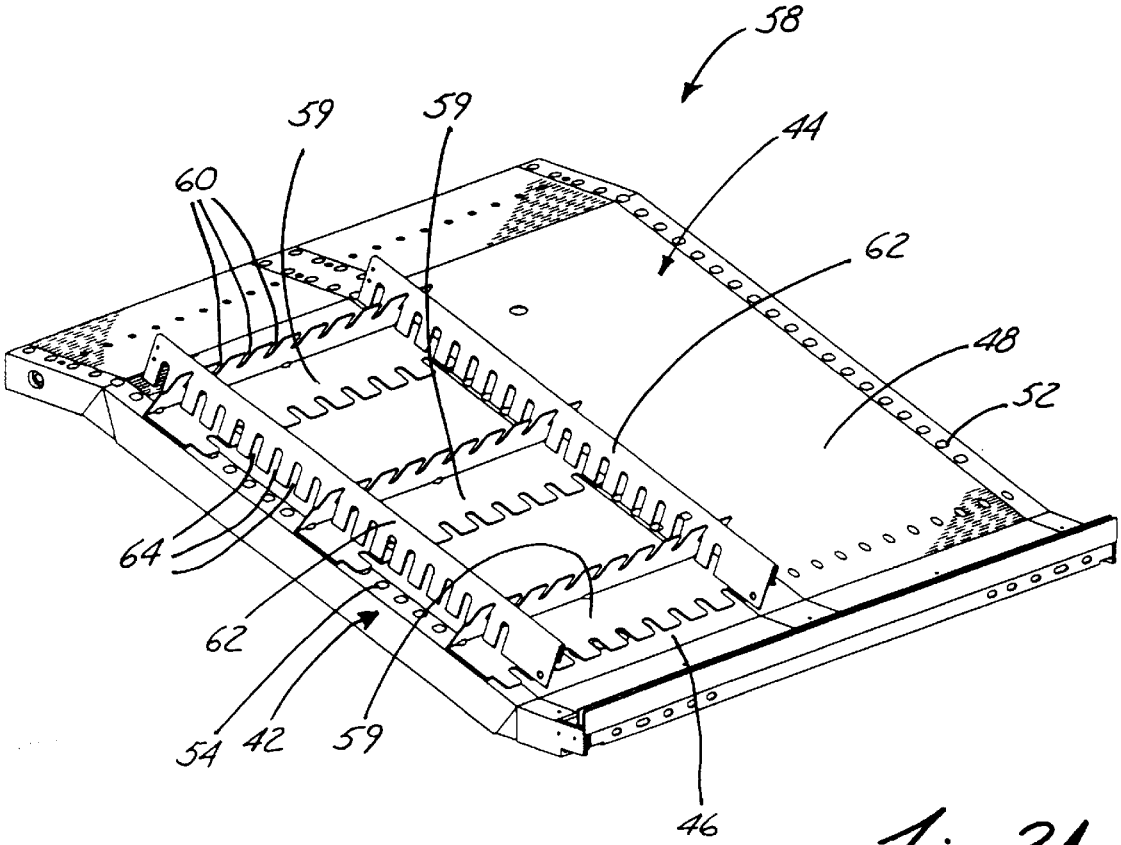
FIGS. 3A and 3B are diagrams of a display rack incorporating both an interlocking divider system and a divider array system.
Figure 3B:
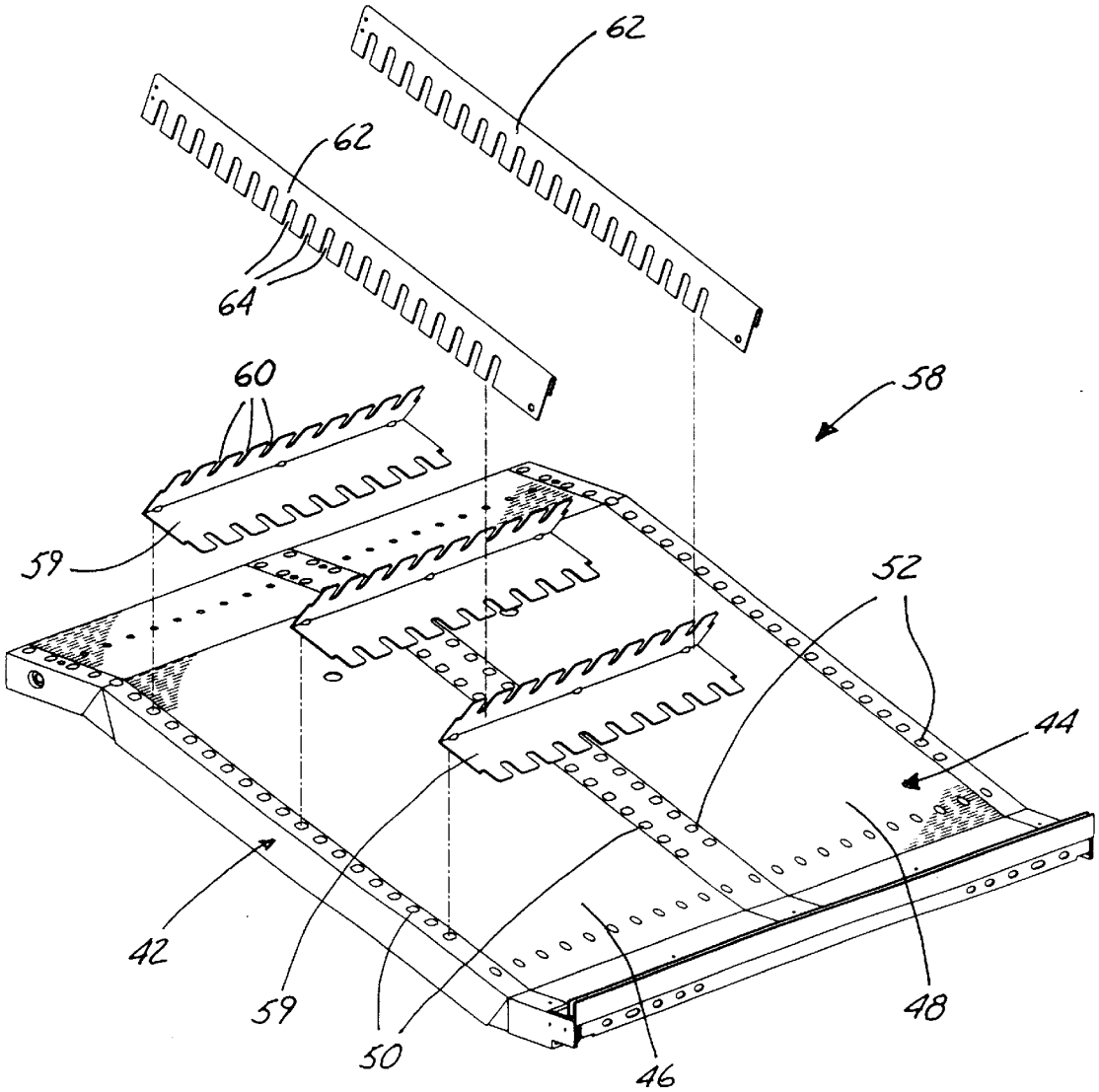

FIGS. 3A and 3B are diagrams of a display rack 58 incorporating both an interlocking divider system as shown in FIG. 1 and a divider array system as shown in FIG. 2. FIG. 3A illustrates the mounting of interlocking horizontal and vertical dividers on rack 58, whereas FIG. 3B provides an exploded view of the dividers. Rack 58 of FIGS. 3A and 3B conforms substantially to rack 40 of FIG. 2, but further includes horizontal dividers 59 having slots 60, and vertical dividers 62 having slots 64. In this embodiment, vertical dividers 62 are removably and selectively interlockable with horizontal dividers 59 via slots 60, 64 to yield additional display flexibility. With multiple horizontal dividers 59 arranged at both different heights and lateral positions, interlocking vertical dividers 62 can be incorporated to not only divide support surface 44 laterally and between the horizontal dividers, but also to subdivide lateral portions of the support surface at different heights. In particular, vertical dividers 62 having different lengths may be particularly advantageous to laterally subdivide different vertical areas of support surface 44. If three horizontal dividers 59 were disposed at different heights within mounting section 48, for example, a vertical divider 62 could be selected with a length sufficient to span the bottom two horizontal dividers, but not the top horizontal divider. In this case, the areas defined by the bottom two horizontal dividers 59 would be subdivided laterally to separately support small quantities of different types of produce, while the top horizontal divider would remain undivided to support a larger quantity of another type of produce. The availability of such options with a single rack 58 provides great versatility and efficiency, particularly for smaller stock quantities.

Figure 4:
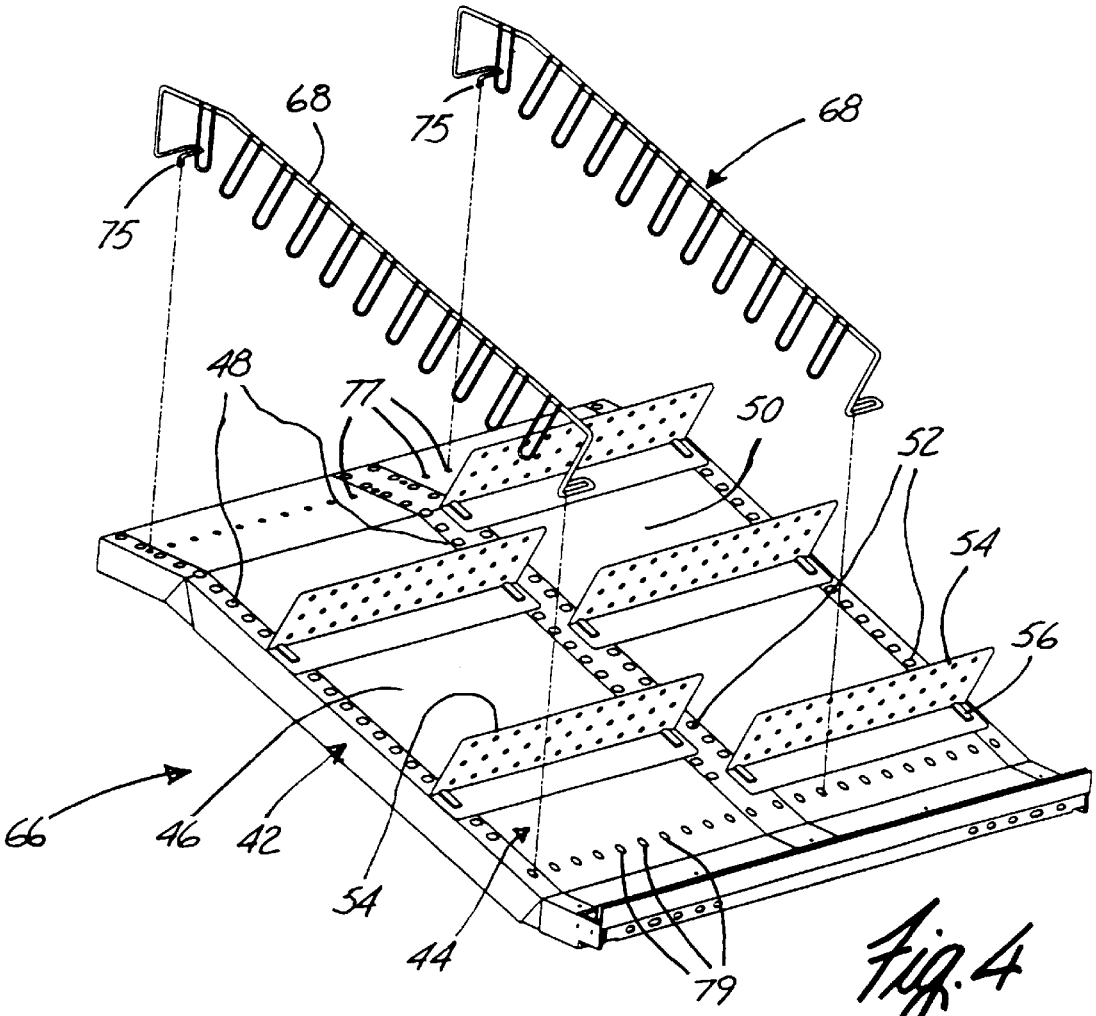
FIG. 4 is a diagram of a display rack incorporating a divider array system and non-interlocking vertical dividers.
Figure 5:
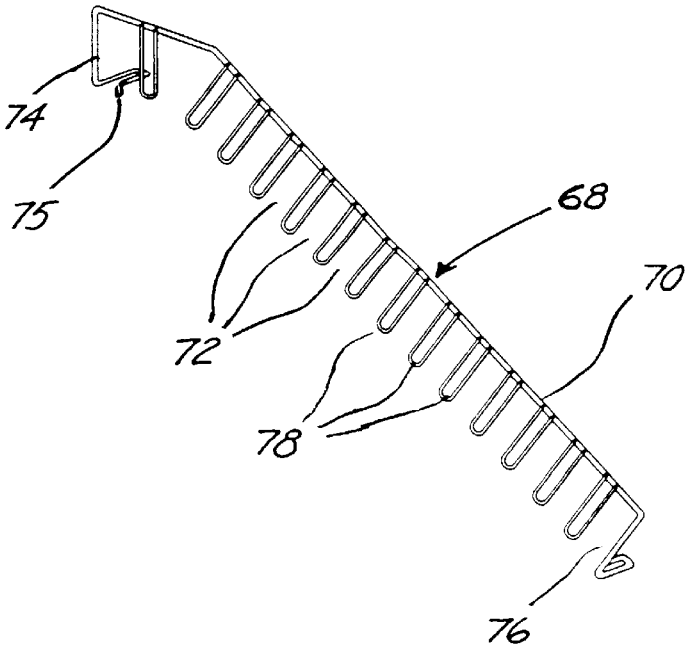
FIG. 5 is a diagram of a non-interlocking vertical divider for use with a display rack as shown in FIG. 4.

FIG. 4 is a diagram of a display rack 66 incorporating a divider array system and non-interlocking vertical dividers. FIG. 4 conforms substantially to FIG. 2, but incorporates a non-interlocking divider system with non-slotted horizontal dividers 54 and wire frame vertical dividers 68. FIG. 5 is a diagram of a non-interlocking vertical divider 68 for use with a display rack 66 as shown in FIG. 4. Display rack 66 is highly advantageous in terms of the ability to mount horizontal dividers 54 at both different heights and in laterally adjacent mounting sections 46, 48. Rack 66 also enables lateral separation of displayed items by vertical dividers 68. In particular, vertical dividers 68 have a wire frame 70 configured to define a series of gaps 72 that engage the edges of horizontal dividers 54, opposing support arms 74, 76 that rest on support surface 44, and adjacent teeth 78 on opposite sides of the gaps. Horizontal and vertical dividers 54, 68 of rack 66 do not provide, however, an interlocking engagement.

Wire teeth 78 adjacent gaps 72 are oriented to bear against horizontal dividers 54 when vertical divider 68 moves in a "vertical" direction, i.e., transverse to the lateral extent of the horizontal dividers. Thus, wire teeth 78 are effective in limiting the movement of vertical divider 68 in one direction. However, vertical divider 68 generally would be free to slide along the extent of each of horizontal dividers 54 absent an additional mounting pin 75 at each end of the vertical divider. In the example of FIG. 4, mounting pins 75 are oriented to engage holes 77, 79 formed along the top and bottom, respectively of surface 44. The engagement of pins 75 with holes 77, 79 allows vertical divider 68 to resist movement, e.g., in response to forces applied during stocking or removal of items by shoppers, thereby maintaining a desired lateral position. The ability of divider 68 to provide lateral separation in combination with the divider array capabilities provided by mounting sections 46, 48 presents considerable advantage and versatility in a single rack.

FIGS. 6A and 6B are diagrams illustrating full-length horizontal dividers 80 for use with a display rack as shown in FIGS. 2 or 4. FIGS. 7A and 7B are diagrams illustrating a section-length vertical divider 82 for use with a display rack as shown in FIGS. 2 or 4. FIGS. 6B and 7B are exploded to illustrate exemplary mounting hardware carried by dividers 80, 82 for engagement with mounting holes 48, 52, as applicable, on support surface 44. Specifically, as shown in FIGS. 6B and 7B, the mounting hardware may take the form of angled tabs 56 having a portion 84 that mounts within holes 86 defined by divider 80, 82, and a portion 88 that extends outward for removable mounting in holes 48, 52, as applicable, of support surface 44. Each horizontal divider 80, 82 may include a tab 56 mounted at opposite ends for engagement with a pair of holes 48, 52 in respective mounting section 46, 50. As further shown in FIGS. 6A and 6B, each horizontal divider 80, 82 may take the form of a bracket having a first divider surface 90 and a second divider surface 92 oriented at an angle relative to one another. For example, first and second divider surfaces 90, 92 can be oriented to provide a right angle bracket. At least a portion of first divider surface 90 lies substantially parallel to, and preferably flat against, support surface 44 when mounted to support member 42. Second divider surface 92 then extends outwards to support items to be displayed.

First and second divider surfaces 90, 92 can have the same width, i.e., in a direction extending transverse to the longitudinal extent of horizontal divider 54. As an optional alternative, however, first and second divider surfaces 90, 92 can be sized to have different widths, and can be configured to receive tabs 56 with opposite orientations on a selective basis. In this manner, one of the first and second vertical divider surfaces 90, 92 can be made selectively mountable on surface 44 of support member 42 to achieve different shelf depths. This feature may be advantageous in light of the range of sizes presented by different items such as different types of produce. If the rack is used to display lemons, for example, the depth of a smaller divider section 90 may be sufficient. In this case, a larger divider section 92 may be mounted against support surface 44. If grapefruit are to be displayed, however, the user can reverse the orientations of tabs 56 within holes 86 and mount the smaller divider section 90 against support surface 44. In this case, the larger divider section 92 extends outward and provides a greater depth to better accommodate larger produce. Thus, horizontal dividers 80, 82 are readily adjustable to provide different shelf depths as a function of the type or size of produce to be displayed. This adjustability extends not only to vertical and lateral position, but also to depth. In this manner, the rack can provide three-dimensional adjustability, while maintaining ease of installation and repositioning.

As further shown in FIGS. 6A and 6B, a full-length horizontal divider 80 can be provided that is sized to span both mounting sections 46, 48, or a single continuous mounting section in a rack that does not implement a divider array system. Specifically, full-length divider 80 can be equipped with mounting hardware at positions selected to engage mounting sites within both mounting sections 46, 50. With reference to FIG. 4 and FIG. 6A, for example, full-length divider 80 could have a mounting structure that engages one of the mounting holes 48 at the far left edge of support surface 44 in mounting section 46, as well as a mounting structure that engages one of the mounting holes 52 at the far right edge of the support surface in mounting section 48. Thus, although rack 40 or 66 can be configured with a divider array system to include two or more mounting sections 46, 48, a full-length horizontal divider 80 can be provided on an optional basis to extend across the entire area of support surface 44. This feature allows still further display flexibility, allowing some items to be displayed in lateral sub-sections of support surface 44 with other items being displayed across the entire support surface. FIGS. 7A and 7B illustrate section-length horizontal dividers 82 for use with or independent of full-length horizontal dividers 80. Each section-length horizontal divider 82 is sized to mount within a single mounting section 46, 48. For example, each section-length horizonal divider 82 may include mounting structures that are positioned to engage pairs of mounting holes 50 or 52 provided in each mounting section 46, 48. In this manner, section-length horizontal dividers 82 can be mounted at different vertical positions and different lateral positions over support surface 44, either side-by-side with or vertically offset from section-length horizontal dividers disposed in adjacent lateral mounting sections 46, 48.

Figure 8A:
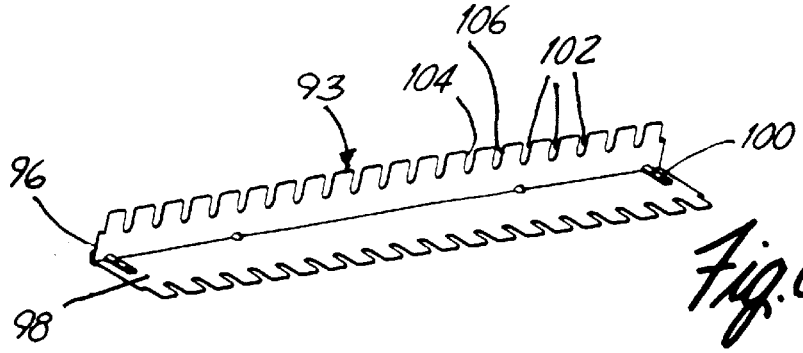
FIGS. 8A and 8B are diagrams illustrating full-length, variable depth interlocking horizontal dividers for use with a display rack as shown in FIGS. 1, 3A, and 3B.
Figure 8B:
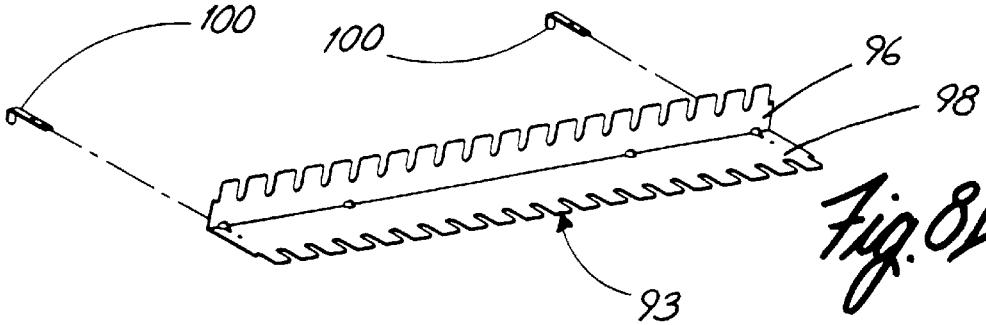
Figure 9A:
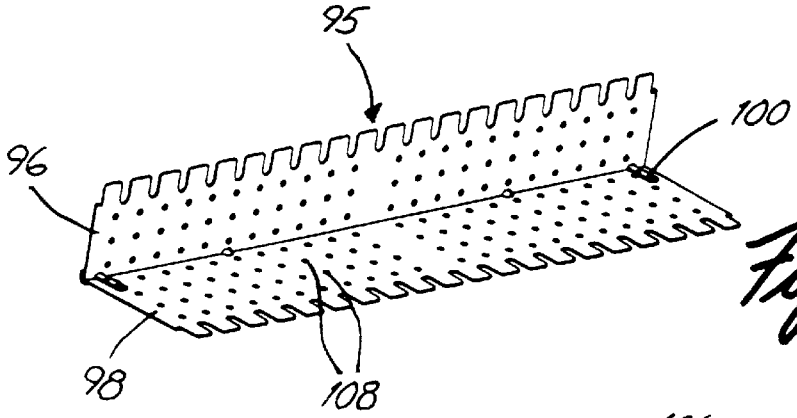
FIGS. 9A and 9B are additional diagrams illustrating full-length, variable depth interlocking horizontal dividers for use with a display rack as shown in FIGS. 1, 3A, and 3B.
Figure 9B:
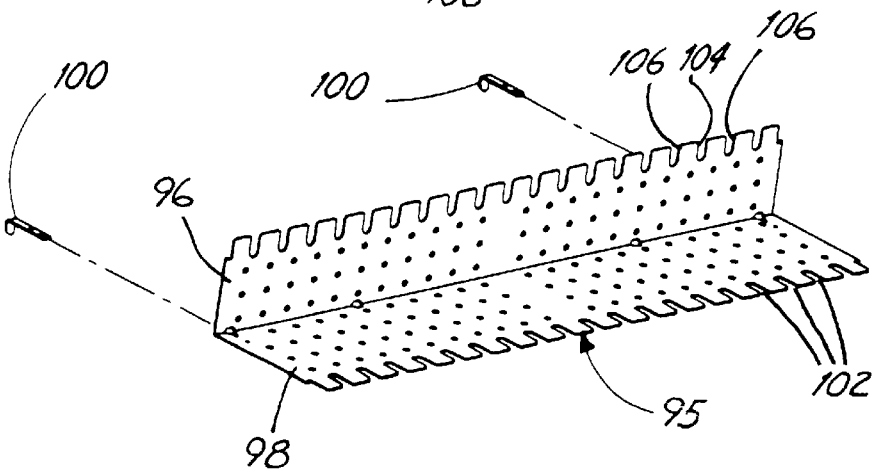
Figure 10A:
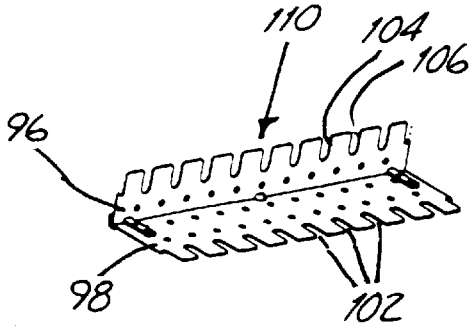
FIGS. 10A and 10B are diagrams illustrating section-length, variable depth interlocking horizontal dividers for use with a display rack as shown in FIGS. 3A and 3B.
Figure 10B:
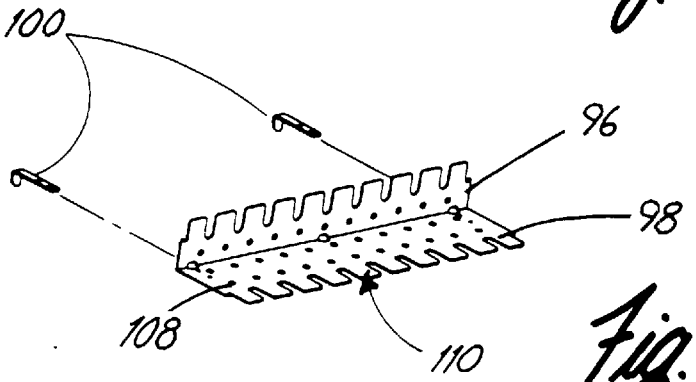
Figure 11A:
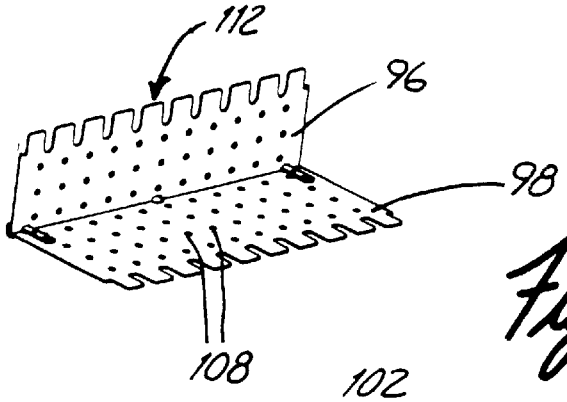
FIGS. 11A and 11B are additional diagrams illustrating section-length, variable depth interlocking horizontal dividers for use with a display rack as shown in FIGS. 3A and 3B.
Figure 11B:
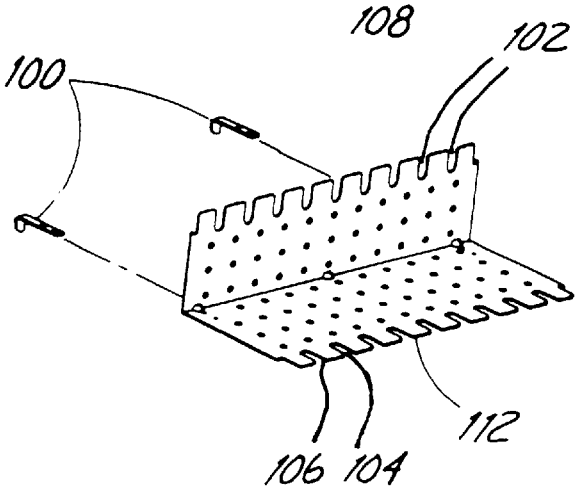

FIGS. 8A, 8B, 9A, 9B, 10A, 10B, 11A, and 11B are diagrams illustrating a variety of interlocking horizontal dividers for use with a display rack as shown in FIGS. 1 and 3. FIGS. 8A–8B and 9A–9B illustrate full-length horizontal dividers 93, 95, respectively. Dividers 93, 95 conform substantially to full-length divider 80 of FIGS. 6A and 6B. For example, each divider 93, 95 has a bracket configuration including a first divider section 96 and a second divider section 98 disposed at an angle relative to one another and having different depths. FIGS. 8A and 8B illustrate, for example, a divider 93 having a first divider section 96 with a depth of approximately two inches and a second divider section 98 with a depth of approximately three inches. FIGS. 9A and 9B illustrate, in contrast, a divider 95 having a first divider section 96 with a depth of approximately four inches and a second divider section 98 with a depth of approximately five inches. Availability of dividers 93, 95 with both sets of depth dimensions further increases the number of options and flexibility provided by the rack.

Dividers 93, 95 include reversible tabs 100 for engagement with mounting holes 50, 52, as applicable, on support surface 44. The reversible tabs 100 facilitate selective mounting of divider sections 96, 98 to achieve desired shelf depth. In addition to the above features, each divider 92, 94 is configured with a slot pattern for implementation of an interlocking divider system. Specifically, each of divider sections 96, 98 preferably includes a pattern of slots 102. Each slot 102 is defined by a pair of side surfaces 104, 106 that are oriented to bear against a vertical divider when the vertical divider is moved laterally within the slot. Dividers 92, 94 can be manufactured, for example, by stamping and bending sheet metal such as aluminum. The aluminum can be perforated to provide air circulation holes 108, if desired. As one alternative, dividers 92, 94 could be realized by wire frames formed and bent to define slots 102 and side surfaces 104, 106, as appropriate.

FIGS. 8A–8B and 9A–9B illustrate full-length horizontal dividers 93, 95 that are sized to extend across two or more mounting sections or a single continuous mounting section in the event the rack does not implement a divider array system as shown in FIG. 3. FIGS. 10A–10B and 11–11B illustrate section-length dividers 110, 112 that substantially correspond to horizontal dividers 93, 95, but are sized for mounting within a single mounting sections, such as sections 46, 48 shown in FIGS. 2 and 4. Like dividers 93, 95, section-length horizontal dividers 110, 112 incorporate reversible mounting sections 96, 98 for shelf depth selection and slots 102 for implementing an interlocking divider system. Also, section-length horizontal dividers 110, 112 may incorporate air circulation holes 108. Again, horizontal dividers 110, 112 preferably are formed from sheet metal, but could be realized by a wire-frame configuration. Section-length horizontal dividers 110, 112 can be mounted alone or in combination with one or more full-length horizontal dividers 92, 94, as well as interlocking vertical dividers, to provide a variety of display options with three-dimensional adjustment.

Figure 12A:
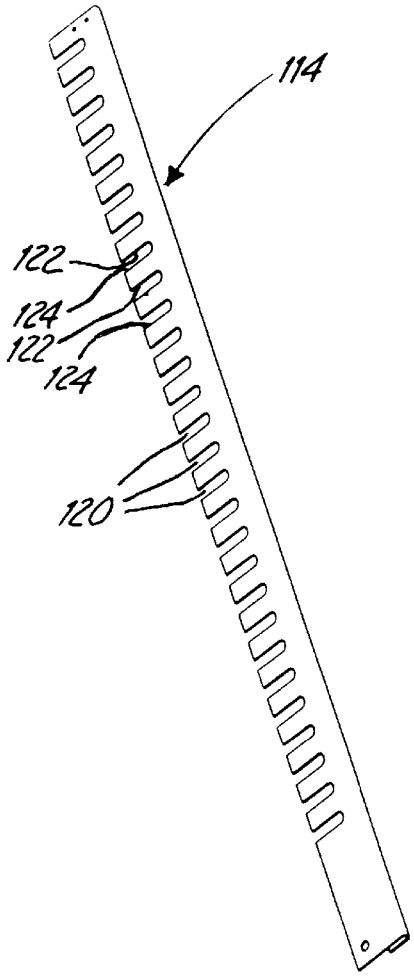
FIGS. 12A, 12B, and 12C are diagrams illustrating interlocking vertical dividers with varied lengths for use with a display rack as shown in FIGS. 1, 3A, and 3B.
Figure 12B:
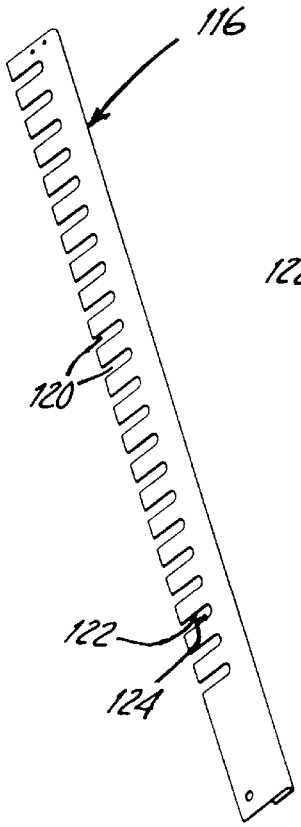
Figure 12C:
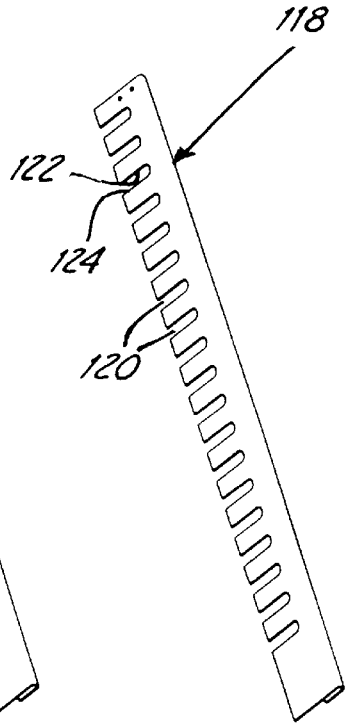

FIGS. 12A, 12B, and 12C are diagrams illustrating interlocking vertical dividers 114, 116, 118, respectively, with varied lengths for use with a display rack as shown in FIGS. 1 and 3. Each of vertical dividers 114, 116, 118 defines a pattern of slots 120 and side surfaces 122, 124 adjacent the slots for interlocking engagement with slots 102 defined by horizontal dividers 92, 94, 110, 112. With reference to FIG. 3, for example, divider 114 is sized to extend over substantially the entire height of the support surface 44. Divider 116 could be sized smaller to cover a portion of support surface 44, while divider 118 could be sized still smaller. In this manner, a user can select one of vertical dividers 114, 116, 118 to divide support surface 44 and, if desired, subdivide the support surface vertically on a selective basis. Whereas divider 114 could be selected to laterally divide the entire support surface 44, for example, divider 118 could be selected to laterally divide only a vertical portion of the support surface. Dividers 116, 118 could be mounted on a lower portion of support surface 44, or mounted on one or more horizontal dividers 92, 94, 110, 112 on an upper portion of the support surface. Thus, dividers 116, 118 could be used to subdivide a number of box-like areas to hold items to be displayed. The feature provides enhanced organizational capabilities in a single rack, particularly for smaller stock quantities or several types of produce.

Figure 13:
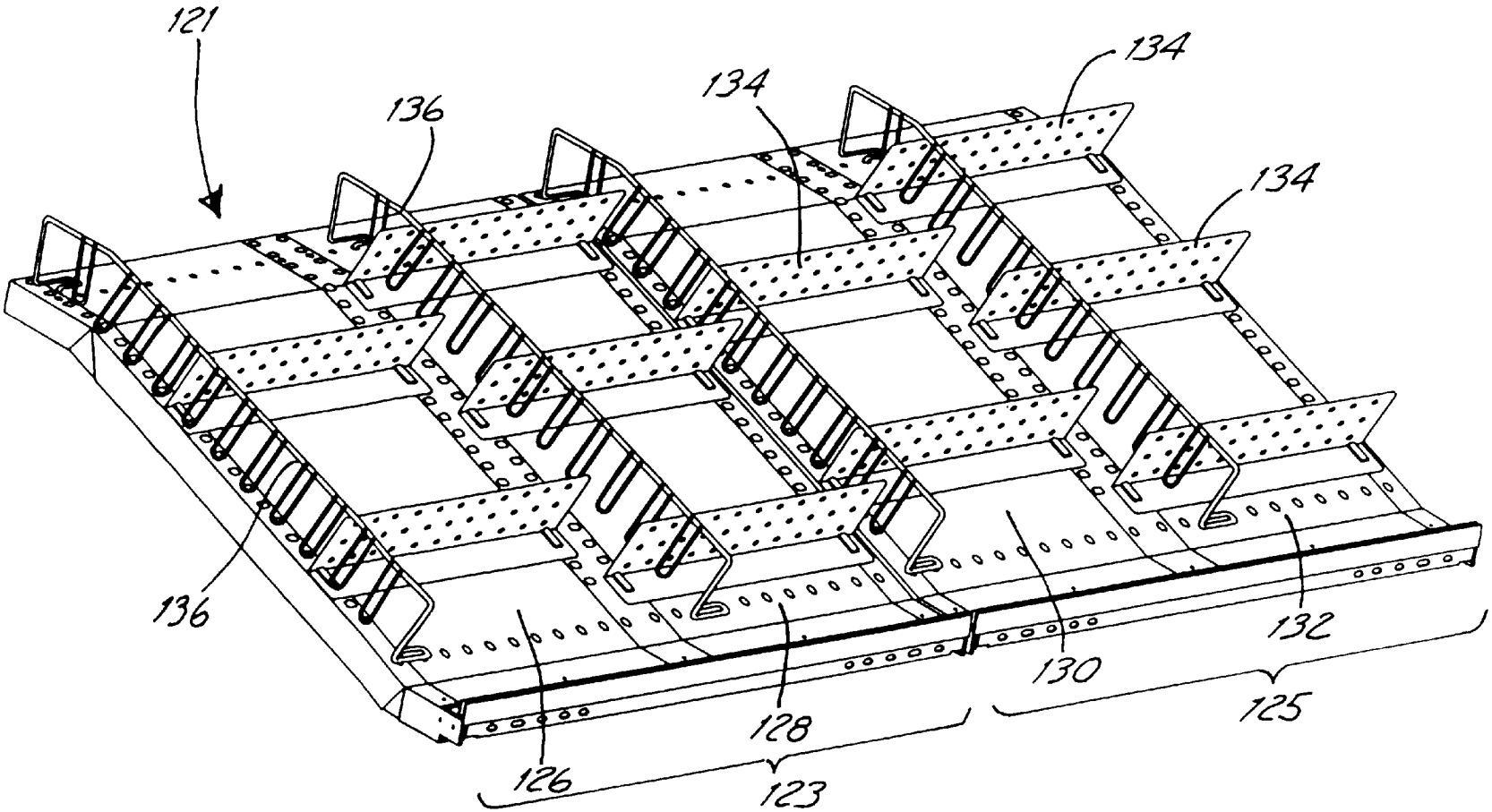
FIG. 13 is a diagram of a display rack system incorporating a divider array with four different horizontal divider mounting sections and non-interlocking vertical dividers.

FIG. 13 is a diagram of a display rack system 121 incorporating racks 123, 125 forming a divider array with four different horizontal divider mounting sections 126, 128, 130, 132 and non-interlocking vertical dividers. FIG. 13 includes racks 123, 125 substantially as shown in FIG. 4, but illustrates the extension capabilities of the divider array feature. Specifically, as shown in FIG. 13, two or more racks 123, 125 can be mounted side-by-side to provide a virtually seamless series of lateral mounting sections that accommodate both section-length horizontal divider members 134, as well as full-length horizonal dividers (not shown in FIG. 13). Also, horizontal divider members can be sized to span any multiple of section lengths, e.g, one, two, or three mounting sections. Non-interlocking dividers, such as wire frame dividers 136, also can be provided for organization.

Figure 14:
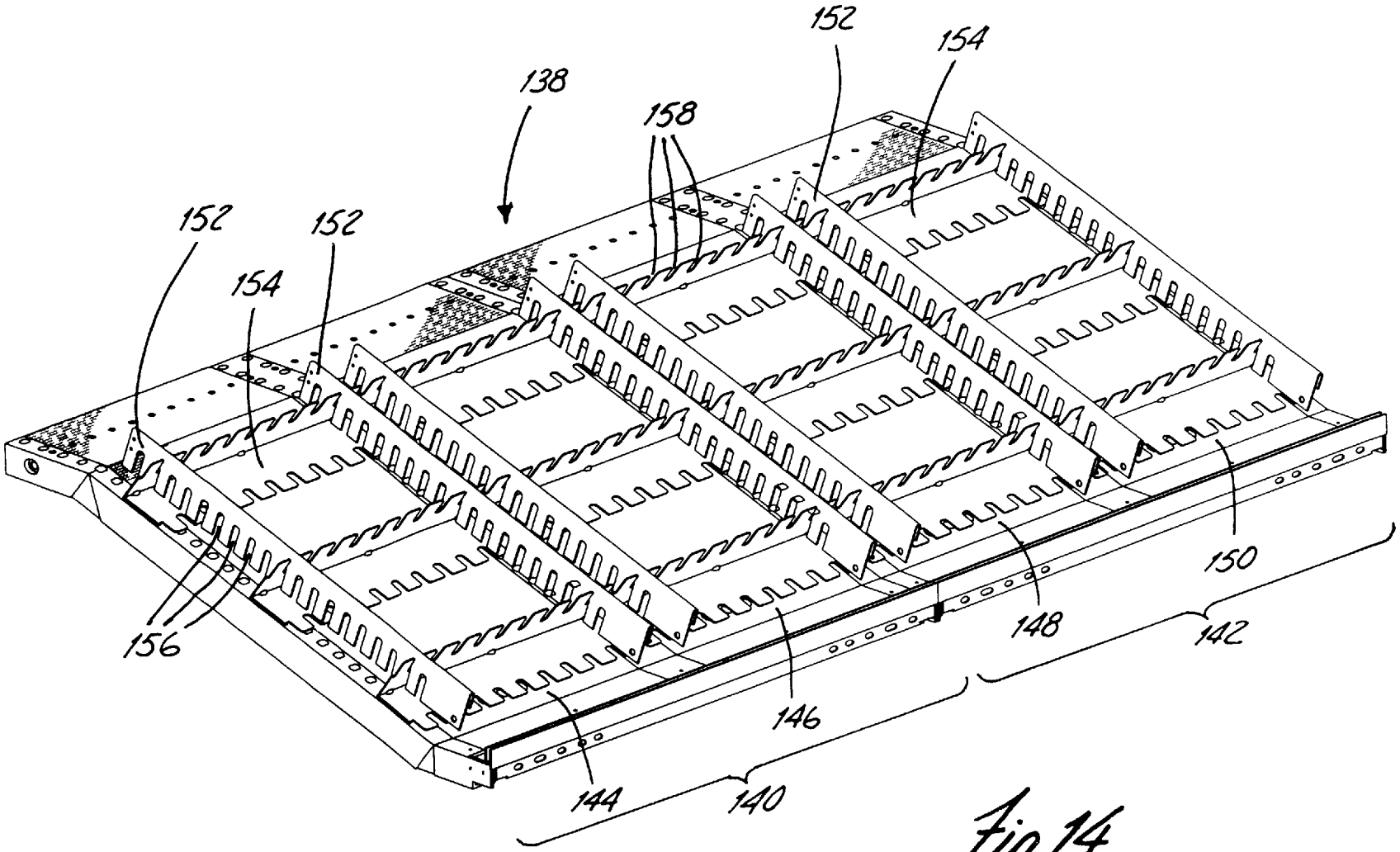
FIG. 14 is a diagram of a display rack system incorporating a divider array with four different horizontal divider mounting sections and interlocking vertical dividers.

FIG. 14 is a diagram of a display rack system 138 incorporating racks 140, 142 forming a divider array with four different horizontal divider mounting sections 144, 146, 148, 150 and interlocking vertical dividers. Each rack 140, 142 in FIG. 14 is substantially as shown in FIG. 3, but mounted side-by-side to realize a series of lateral mounting sections 144, 146, 148, 150 along with an interlocking divider system. Specifically, display rack system 138 incorporates vertical dividers 152 and horizontal dividers 154 defining slots 156, 158, respectively, for interlocking engagement.

Figure 15:
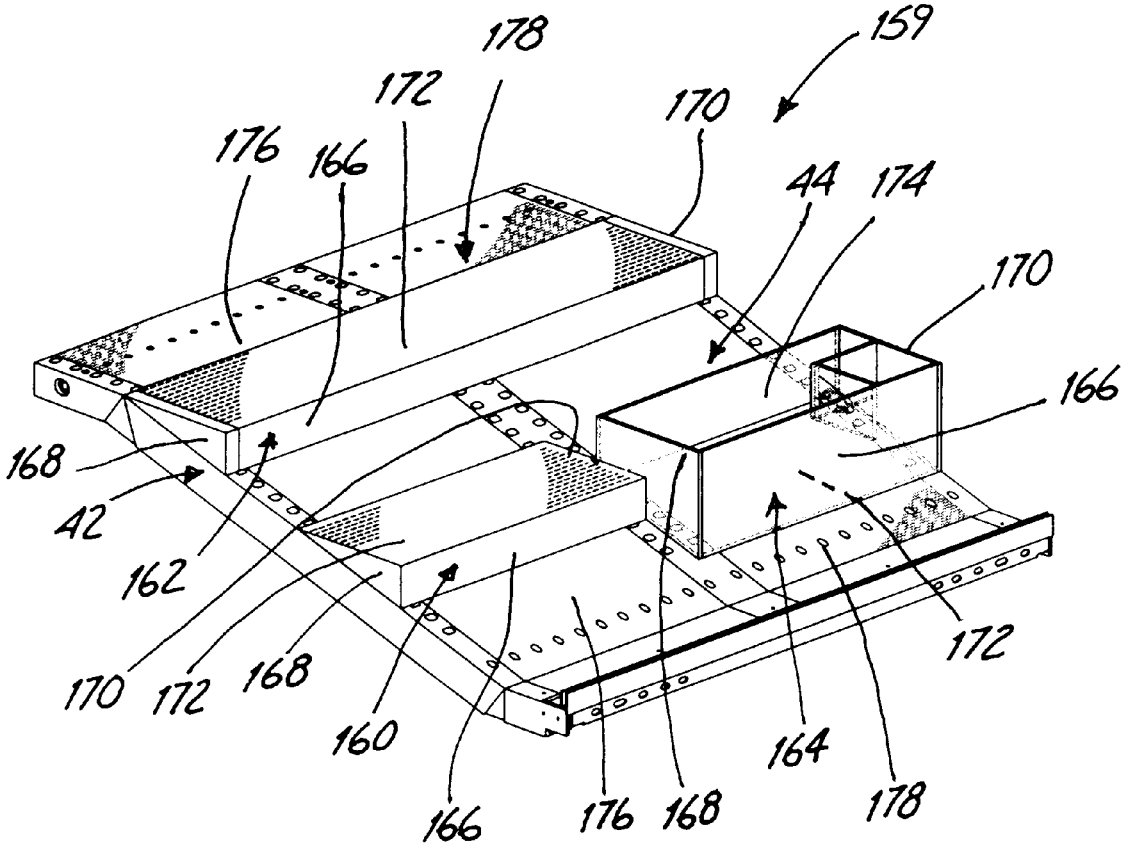
FIG. 15 is a diagram of a display rack system incorporating a divider array with bin-like dividers.

FIG. 15 is a diagram of a display rack 159 illustrating another application of a divider array system. Rack 159 substantially conforms to rack 40 of FIG. 2. In the example of FIG. 15, however, each horizontal divider 160, 162, 164 takes the form of a walled bin. Specifically, each vertical divider 160, 162, 164 includes a front wall 166, two side walls 168, 170, and a bottom wall 172. Divider 160 is mounted within a first mounting section 176 such that bottom wall 172 lies substantially flat against support surface 44. Divider 164, in a second mounting section 178, includes a rear wall 174 that extends outward from support surface 14. Dividers 160, 162, 164 can be formed, for example, from metal, molded plastic, or wire frame baskets. In particular, any of dividers 160, 162, 164 could be formed from a substantially transparent material, such as plexiglass, to facilitate visibility of items through walls 166, 168, 170, and 174, as applicable. Divider 164, in particular, illustrates the use of a transparent material for visibility of items.

Side walls 168, 170 slope outward to define a pair of lateral retaining walls, whereas bottom wall 172 defines a lower support surface. With side walls 168, 170 and bottom wall 172, horizontal dividers 160, 162 are configured to hold a variety of items including, in particular, items contained in cans, jars, or other containers. Side walls 168, 170 serve to integrate a vertical divider function with horizontal dividers 160, 162, 164. The rear wall 174 of divider 164, along with deeper side walls 168, 170, make the divider particularly suitable for salad, prepared food, condiments, and other items. As shown in FIG. 15, the bin-like dividers 160, 162, 164 can be sized for mounting within individual mounting sections 176, 178, or sized to span both mounting sections. In racks with greater numbers of mounting sections, bin-like dividers 160, 162, 164 can be sized to span any multiple of the mounting sections.

With a vertical divider 160, 162, 164 constructed as shown in FIG. 15 and application of a divider array, rack 158 provides flexibility not only in terms of display, but also with respect to the items to be displayed. Each bottom wall 172 can be angled to extend outward at substantially a right angle relative to support surface 14. Moreover, horizontal dividers 160, 162 can be configured as shown in FIG. 15 to include a pattern of slots on bottom walls 172 to receive a corresponding pattern of slots on a vertical divider as shown in FIGS. 12A–12C. In this manner, the bin-like volumes defined by horizontal dividers 160, 162 can be laterally divided within a given mounting sections 176, 178, allowing application of an interlocking divider system as described herein.

A number of embodiments of the present invention have been described. Nevertheless, it will be understood that various modifications may be made without departing from the spirit and scope of the invention. Accordingly, other embodiments are within the scope of the following claims.

What is claimed is:

1. A display rack for displaying grocery items, comprising:

a support surface comprising an arrangement of mounting sites;

an interlocking divider system comprising at least a first horizontal divider and at least one vertical divider, wherein at least one of the first horizontal divider and the vertical divider comprises a structure for removable engagement with the mounting sites in the support surface;

wherein the first horizontal divider comprises at least one first slot and the vertical divider comprises at least one second slot, and the second slots in the vertical divider are interlockable with the first slots in the first horizontal divider so that at least one second slot on the vertical divider may be removably engaged with at least one first slot on the first horizontal divider, wherein the support surface is vertically oriented with respect to a plane of the surface on which the rack is mounted, wherein the first horizontal divider comprises a first horizontal divider surface and a second horizontal divider surface oriented at an angle relative to one another, the first horizontal divider surface is selectively mountable on the support surface such that at least a portion of the first horizontal divider surface is substantially parallel to the support surface and the second horizontal divider surface extends outward from the support surface to support the displayed items, and wherein each of the first and second horizontal divider surfaces includes at least one of the first slots to provide interlocking engagement with the second slots in the a vertical divider.

2. The display rack of claim 1, wherein the first slots are substantially equidistant from one another along the first horizontal divider.

3. The display rack of claim 1, wherein the second slots are substantially equidistant from one another along the vertical divider.

4. The display rack of claim 1, wherein the first horizontal divider is removably engaged at a first mounting site on the support surface, and the rack further comprises:

a second horizontal divider removably engaged at a second mounting site on the support surface different from the first position, the second horizontal divider comprising at least one third slot, wherein each of the third slots is interlockable with one of the second slots on the vertical divider so that at least one second slot at a selected position on the vertical divider may be removably engaged with at least one third slot at a selected position along the second horizontal divider.

5. The display rack of claim 1, wherein the support surface, vertical divider, and the first horizontal divider are formed from sheets of metal.

6. A display rack as claimed in claim 1, wherein the support surface is tilted away from the vertical with respect to the plane of the surface on which the rack is mounted.

7. A display rack as claimed in claim 1, wherein the support surface is generally planar.

8. A display rack as claimed in claim 1, wherein the support surface has a stepped profile.

9. A display rack as claimed in claim 1, wherein the first and second divider surfaces have different depths with respect to the support surface.

10. A display rack as claimed in claim 1, wherein the support surface is perforated.

11. A display rack as claimed in claim 1, wherein at least one of the horizontal divider and the vertical divider is perforated.

12. A display rack as claimed in claim 1, wherein the structures for removable engagement are on the dividers.

13. A display rack for displaying grocery items in a display case comprising:

a support member for attachment to a display case, the support member having a substantially flat surface to support items to be displayed, wherein the surface of the support member is oriented at an angle with respect to a plane of a surface of the display case, and wherein the surface of the support member comprises an arrangement of mounting sites;

a first horizontal divider extending in a first direction laterally across the surface of the support member, wherein the first horizontal divider comprises a mounting structure which may be removably engaged with a mounting site on the surface of the support member, the first horizontal divider further comprising a plurality of first slots;

a second horizontal divider extending in the first direction laterally across the surface of the support member, wherein the second horizontal divider comprises a mounting structure which may be removably engaged with a mounting site on the surface of the support member, the second horizontal divider further comprising a plurality of second slots; and a vertical divider extending in a second direction substantially perpendicular to the first direction, the vertical divider defining a plurality of third slots;

wherein each of the third slots in the vertical divider is removably interlockable with one of the first slots in the first horizontal divider and with one of the second slots in the second horizontal divider, so that at least one third slot on the vertical divider may be removably engaged with at least one first slot on the first horizontal divider or at least one second slot on the second horizontal divider.

14. The display rack of claim 13, wherein at least one of the first and second horizontal dividers comprises a first horizontal divider surface and a second horizontal divider surface oriented at an angle relative to one another, the first horizontal divider surface is selectively mountable on the surface of the support member such that at least a portion of the first horizontal divider surface is substantially parallel to the surface of the support member and the second horizontal divider surface extends outward from the surface of the support member to support the displayed items, wherein each of the first and second horizontal divider surfaces of the first horizontal divider comprises a plurality of the first slots, and each of the first and second horizontal divider surfaces of the second horizontal divider surface comprises a plurality of the second slots.

15. The display rack of claim 14, wherein the first and second horizontal divider surfaces for each of the first and second horizontal dividers have different depths.

16. The display rack of claim 13, further comprising a second vertical divider extending in the second direction, wherein the second vertical divider comprises a plurality of fourth slots, each of the fourth slots being interlockable with one of the first slots and with one of the second slots, so that at least one fourth slot on the second vertical divider may be removably engaged with at least one first slot on the first horizontal divider or at least one second slot on the second horizontal divider.

17. The display rack of claim 13, wherein the first slots are substantially equidistant from one another along the first horizontal divider, the second slots are substantially equidistant from one another along the second horizontal divider, and the third slots are substantially equidistant from one another along the vertical divider.

18. A display rack for displaying grocery items, comprising:

a support surface comprising an arrangement of mounting sites;

an interlocking divider system comprising at least one horizontal divider and at least one vertical divider, wherein at least one of the horizontal divider and the vertical divider comprise a structure for removable engagement with the mounting sites in the support surface;

wherein the horizontal divider comprises at least one first slot and the vertical divider comprises at least one second slot, and the second slots in the vertical divider are interlockable with the first slots in the horizontal divider so that at least one second slot on the vertical divider may be removably engaged with at least one first slot on the horizontal divider, wherein the support surface is vertically oriented with respect to a plane of the surface on which the rack is mounted, and wherein the structures for removable engagement are tabs.

* * * * *